US005575577A

United States Patent [19]

Kawakami et al.

[11] Patent Number: 5,575,577

[45] Date of Patent: Nov. 19, 1996

[54] RECORDING APPARATUS HAVING POSITION DETECTING DEVICE

[75] Inventors: Yoshio Kawakami; Kohzo Ohkubo; Syuzo Abiko, all of Saitama-ken, Japan

[73] Assignee: Canon Denshi Kabushiki Kaisha, Saitama-ken, Japan

[21] Appl. No.: 234,249

[22] Filed: Apr. 28, 1994

[30] Foreign Application Priority Data

| | | | |
|---|---|---|---|
| Apr. 30, 1993 | [JP] | Japan | 5-104249 |
| Jun. 30, 1993 | [JP] | Japan | 5-161737 |
| Jul. 2, 1993 | [JP] | Japan | 5-164665 |

[51] Int. Cl.[6] ..... B41J 29/24

[52] U.S. Cl. ..... 400/705.1; 400/705; 400/279; 358/472; 358/473

[58] Field of Search ..... 400/705, 705.1, 400/279, 322; 358/472, 473, 474, 296; 318/687; 73/662; 174/196, 189, 137 A; 206/316.1, 328, 460, 497; 359/198, 201, 812

[56] References Cited

U.S. PATENT DOCUMENTS

| | | | |
|---|---|---|---|
| 4,641,148 | 2/1987 | Dyer et al. | 400/248 |
| 4,718,683 | 1/1988 | Perga | 280/6 |
| 5,047,676 | 9/1991 | Ichikawa | 310/12 |
| 5,064,031 | 11/1991 | Kakizaki | 188/299 |
| 5,074,690 | 12/1991 | Del Signore, II et al. | 400/279 |
| 5,297,881 | 3/1994 | Ishiyama | 400/705 |
| 5,368,402 | 4/1994 | Takahashi et al. | 400/279 |

*Primary Examiner*—John S. Hilten

*Attorney, Agent, or Firm*—Robin, Blecker, Daley & Driscoll

[57] ABSTRACT

A recording apparatus of the kind arranged to perform recording by moving a carriage on which a recording head is mounted is provided with a linear encoder which consists of a linear scale part arranged in parallel to a moving route of the carriage to have position information recorded in the longitudinal direction thereof at a predetermined pitch and a detecting head arranged to detect the position information of the scale part. The detecting head includes a protective film thereon and a slider which fittingly engages the scale part and is formed with a polyphenylene sulfide material containing 10 to 50% of a filler.

47 Claims, 6 Drawing Sheets

RECORDING APPARATUS HAVING POSITION DETECTING DEVICE

BACKGROUND OF THE INVENTION

1.Field of the Invention

This invention relates to a recording apparatus and more particularly to a recording apparatus called a serial type recording apparatus (or printer) which is arranged to perform recording by moving a carriage on which a recording head is mounted and by detecting the position of the carriage with a linear encoder, 2. Description of the Related Art A magnetic encoder is a kind of linear encoder, The magnetic encoder consists of a linear magnetic scale part which is magnetized to alternately have opposite polarities in the longitudinal direction thereof at a predetermined pitch and a magnetic head which is arranged to be movable along the magnetic scale part and to detect the magnetic field of the magnetic scale part. The magnetic head is composed of a magnetoresistive element (hereinafter referred to as MR element). It has been proposed to arrange the serial type recording apparatus (or printer) to use this magnetic linear encoder in detecting the position of the carriage on which the recording head is mounted, In the printer of the above-stated kind, the magnetic scale part is sometimes arranged to be used also as a guide shaft. In such a case, the magnetic scale part is formed in a cylindrical shape and used with a grease applied to it as a lubricant, The grease sometimes solidifies or has dust, ink, etc., stuck thereto. In such an instance, these substances tend to stick to the surface of the MR element and come to cause an electrical fault by corroding thin-film patterns which form the MR element.

Further, in a case where the magnetic linear encoder is to be used in a printer arranged to perform color recording in a high-density dot method, the magnetic scale part must be arranged in the following manner to meet requirements in respect to space saving, high speed responsivity, high precision, etc. The magnetic scale part is formed with a thin magnet wire made of an alloy of Fe-Cr-Co, Mn-Al-C or the like measuring about 1 mm in diameter. The magnetizing ranges of N and S poles formed on the wire are respectively set at an extremely small value not exceeding 50 μm. Besides, with respect to durability, the MR element part of the magnetic head and the magnet wire must be kept apart from each other at the time of sliding. The space or gap between the MR element part and the magnetic wire thus must be held within 30 μm or thereabout under these conditions. However, it is difficult to precisely set this gap because of the shape of the slider of the magnetic head. Therefore, the magnetic wire and the MR element part have sometimes come into contact with each other to bring about an electrical fault in the thin-film patterns.

This problem has heretofore been solved either by making the slider with a metal material to enhance the dimensional precision or by using an additional bearing. These solutions, however, have not been efficient as they either increase the number of parts or necessitate a much longer period of time in machining the parts.

SUMMARY OF THE INVENTION

In view of the problems mentioned above, it is an object of this invention to provide a serial type recording apparatus of the kind detecting the position of a carriage by means of, for example, a magnetic linear encoder, wherein, even in a case where a magnetic scale part of the magnetic linear encoder is thin and its pitch of magnetization is extremely small, like the magnet wire mentioned in the foregoing, the position of the carriage can be accurately detected by obtaining a signal for a necessary height from a magnetic head employed as a detecting means of the magnetic linear encoder, and the detecting means is arranged to have an improved characteristic of resisting environmental damage and also to permit simplification of its structural arrangement.

To attain this object, a recording apparatus for performing a recording operation by moving a carriage on which recording means is mounted is arranged according to this invention as an embodiment thereof to include a first member arranged in parallel to a moving locus of the carriage to have position information recorded in the longitudinal direction thereof, detecting means for detecting the position information, and a second member arranged to have the first member slidably fitted therein and to hold the detecting means in such a way as to enable the detecting means to read the position information recorded on the first member, the second member being formed with a polyphenylene sulfide material containing 10 to 50% of a filler.

A recording apparatus for performing a recording operation by moving a carriage on which recording means is mounted is arranged as another embodiment of this invention to include a first member arranged in parallel to a moving locus of the carriage to have position information recorded thereon in the longitudinal direction thereof, detecting means for detecting the position information, and a second member arranged to have the first member slidably fitted therein and to hold the detecting means in such a way as to enable the detecting means to read the position information recorded on the first member, the second member being an integrally formed member having only three opening parts including first and second opening parts in which the first member is fitted and a third opening part through which the position information is read by the detecting means held by the second member.

The above and other objects and features of this invention will become apparent from the following detailed description of embodiments thereof taken in connection with the accompanying drawings.

BRIEF DESCRIPTION OF THE DRAWINGS

FIG. 8(*a*) is a plan view of the slider. FIG. 8(*b*) is a front view of the slider. FIG. 8(*c*) is a sectional view taken across a line A—A shown in FIG. 8(*b*). FIG. 8(*d*) is an enlarged view of a part B shown in FIG. 8(*b*). FIG. 8(*e*) is an enlarged view of a part C shown in FIG. 8(*b*)

DETAILED DESCRIPTION OF THE PREFERRED EMBODIMENTS

An embodiment of this invention is described with reference to the accompanying drawings as follows.

Figure 1:
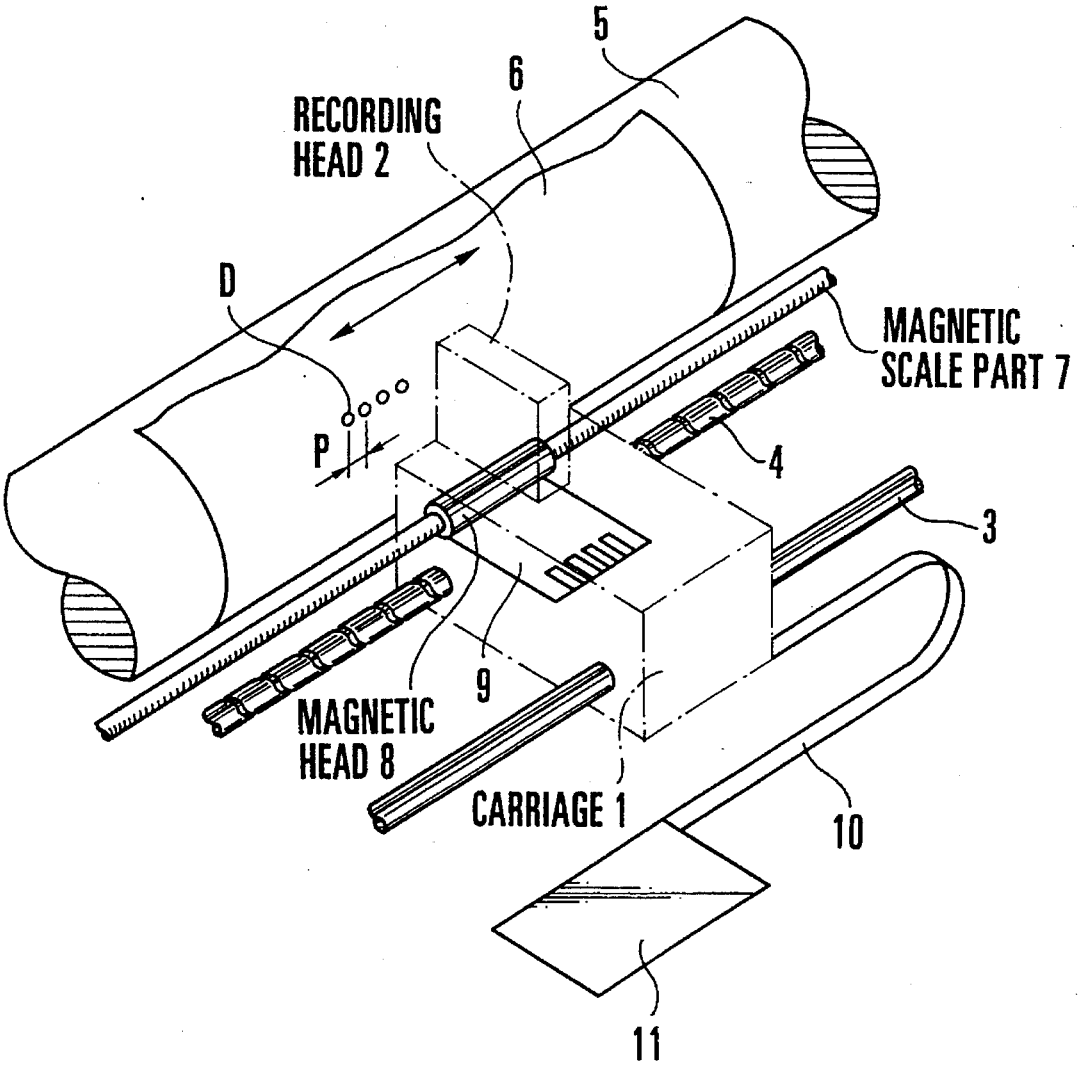
FIG. 1 is an oblique view showing the arrangement of essential parts related to detection of the position of a carriage in a recording apparatus arranged according to this invention as an embodiment thereof.

FIG. 1 shows the arrangement of essential parts related to detection of the position of a carriage in a recording apparatus according to an embodiment of this invention. In FIG. 1, the carriage 1 which is indicated by a one-dot chain line is arranged to be slidable on a guide bar 3. A recording head 2 which is arranged to be operated by an ink jet method or the like is mounted on the carriage 1. A driving shaft 4 which has a helical groove formed round its outer circumference is arranged to guide the carriage 1 to reciprocate along it. More specifically, the carriage 1 has an engaging part which is not shown but is arranged to engage the helical groove of the driving shaft 4. When the driving shaft 4 is rotatively driven by a carriage driving motor which is not shown, the engaging part moves along the helical groove of the driving shaft 4 to cause the carriage 1 to move. Further, in the case of this embodiment, the guide bar 3 and a magnetic scale part 7 are arranged to serve as guides while the driving shaft 4 is feeding and driving the carriage 1 to ensure highly precise feeding. However, the guide bar 3 may be omitted by arranging the driving shaft 4 to serve as a guide bar.

The carriage 1 makes a reciprocative movement along a platen 5 in the directions of the arrows. While the carriage 1 is moving, the recording head 2 is driven to jet ink drops at a recording sheet 6 which is wrapped around the outer circumferential surface of the platen 5. Dots D are thus recorded on the recording sheet 6 at a predetermined pitch P. As a result, an image or a character is recorded in a dot matrix pattern.

A magnetic head 8 is, on the other hand, arranged to form in conjunction with the magnetic scale part 7 a magnetic linear encoder which is arranged to generate a synchronizing signal by detecting the position of the carriage 1. The magnetic scale part 7 is composed of a magnet wire which, as described in the foregoing, measures about 1 mm in diameter and is magnetized alternately into opposite polarities to have N and S poles alternating at a pitch corresponding to the pitch P of the dots D in the longitudinal direction of the magnetic scale part 7. In the drawing, the pitch P of the dots D, i.e., the pitch of magnetization, is shown much larger than its actual size for the sake of illustration. The actual size of the pitch does not exceed 100 μm. The magnetic scale part 7 is stretched in parallel to the driving shaft 4, i.e., in parallel to the moving route of the carriage 1, and is fixed to a body frame (not shown) of the recording apparatus.

The magnetic head 8 is an MR (magnetoresistive) head which is arranged to detect the magnetic field of the magnetic scale part 7 by means of an MR element and is secured to the inside of the carriage 1 in such a way as to be slidable on the magnetic scale part 7. The magnetic head 8 is thus arranged to output a signal corresponding to the magnetic field of the magnetic scale part 7. The signal outputted from the magnetic head 8 is led to a control circuit 11 through a flexible printed circuit board 9 and a flexible cable 10. The control circuit 11 then detects the position of the carriage 1 through the signal outputted from the magnetic head 8.

The details of arrangement of the magnetic head 8 are described below with reference to FIGS. 2 to 4.

Figure 2:
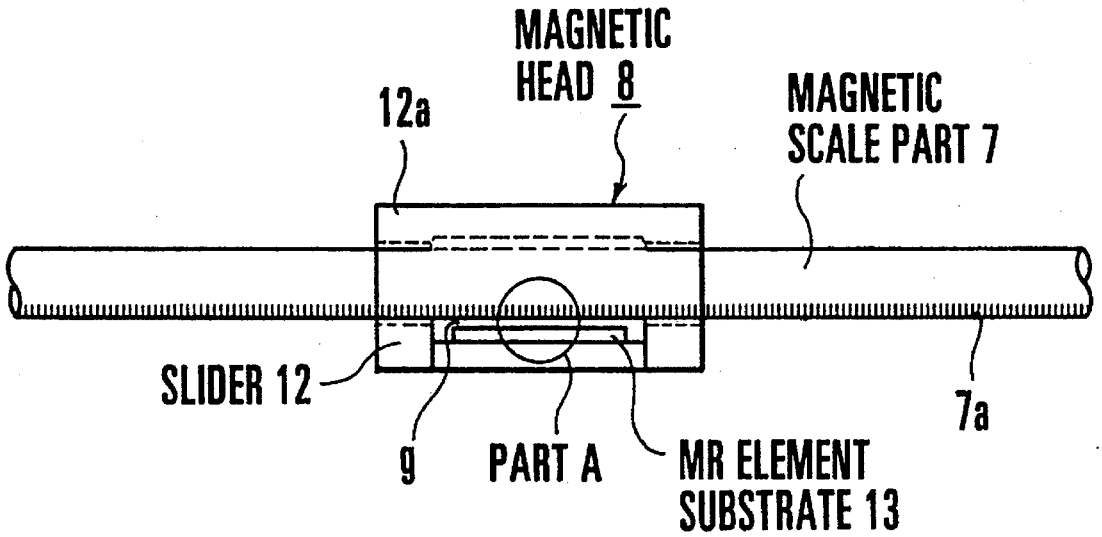
FIG. 2 is a top view showing a magnetic scale part and a magnetic head which constitute a magnetic linear encoder in the same recording apparatus.

Referring to FIG. 2, the magnetic head 8 includes a slider 12 which is arranged in a hollow tubular shape to have the magnetic scale part 7 inserted therein and to be slidable on the magnetic scale part 7 through sliding bearing parts 12*a* formed at two end parts thereof. The slider 12 is secured to the carriage 1.

An MR element substrate 13 which is made of an insulating glass material is secured to the inside of the slider 12. As will be further described later herein, the MR element substrate 13 is opposed to the magnetic scale part 7 in parallel to the latter, leaving a gap "g" between them. A magnetized part 7*a* of the magnetic scale part 7 is disposed on the side of the magnetic scale part 7 confronting the MR element substrate 13.

Figure 3:
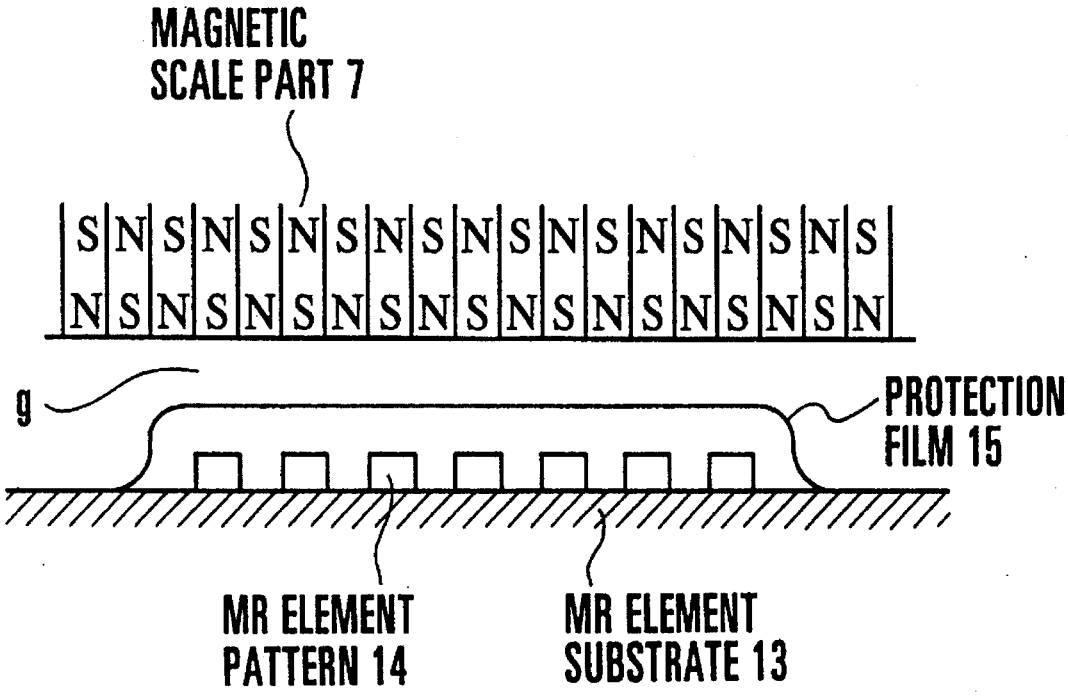
FIG. 3 is an enlarged sectional view of a part A of FIG. 2 schematically showing the magnetized state of the magnetic scale part, the arrangement of MR element patterns, etc.

The MR element is disposed on the surface of the MR element substrate 13, as shown in FIG. 3 which is an enlarged sectional view taken across a part A of FIG. 2. FIG. 3 schematically shows the magnetized state of the magnetic scale part 7 and an arrangement of the patterns of the MR element. As shown, a plurality (seven in this case) of linear MR element patterns 14 which are made of a ferromagnetic material such as Permalloy and constitute the MR element are formed on the surface of the MR element substrate 13. The MR element patterns 14 are arranged in the longitudinal direction of the magnetic scale part 7 at a pitch corresponding to the magnetization pitch between one N pole and another N pole or between one S pole and another S pole of the magnetic scale part 7. Further, a protection film 15 which is made of an insulator is formed on the MR element substrate 13 to cover all the MR element patterns 14.

The film thickness of the MR element patterns 14 is about 500 angstroms. To ensure an adequate magnetic characteristic of the MR element patterns 14, the gap "g" must be arranged to be 20 μm±5 μm or thereabout. For this purpose, the film thickness of the protection film 15 also must be 10 μm±3 μm or thereabout.

FIG. 3 only schematically shows in a sectional view the arrangement of the MR element part. In an actual application of this invention, the number of the MR element patterns 14 is larger than what is shown in FIG. 3. The protection film 15 is preferably arranged to be two layers of film. FIG. 4 is a plan view showing by way of example a practical structural arrangement of the magnetic head 8. In FIG. 4, the surface of the MR element part of the magnetic head 8 is shown in a state of being viewed transparently through the protection film 15.

Figure 4:
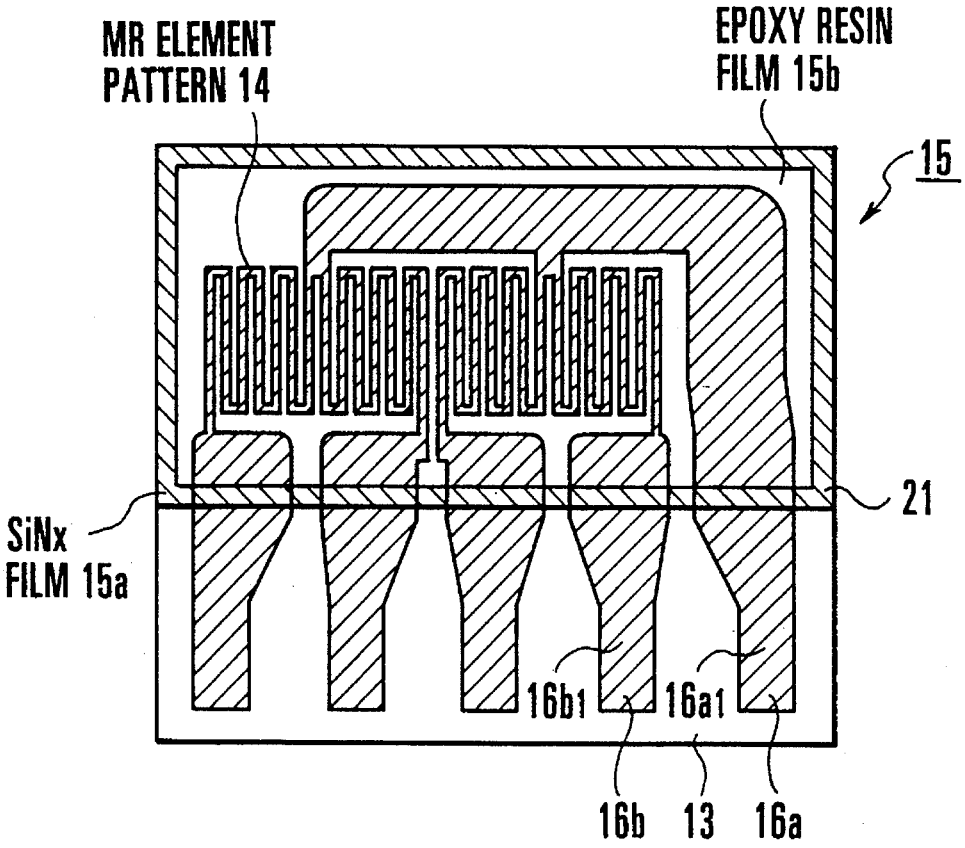
FIG. 4 is a plan view showing the surface of an MR element part of the magnetic head through a protection film which covers the surface of the MR element part.

In the case of FIG. 4, there are provided four groups of the MR element patterns 14, each group consisting of seven MR element patterns 14 which are interconnected in a meanderingly zigzag manner. Thin-film patterns of electrodes 16*a* and 16*b* are connected to the two ends of each of these groups. In other words, the MR element is composed of a total of twenty-eight MR element patterns.

Further, the protection film 15 consists of two layers of film including an $SiN_X$ film 15*a* (X=0.05 atomic % or more) which is formed immediately above the MR element patterns 14 and an epoxy resin film 15*b* which is made of a UV epoxy resin and is formed above the film 15*a*. The reason for arranging the protection film 15 in this manner is as follows.

The film thickness of the protection film 15 must be not exceed 10 μm±3 μm as mentioned above. In accordance with a simple expedient method generally employed, the film thickness can be controlled by screen process printing, spin coating, or the like, with a UV epoxy resin used. In this instance, for the purposes of suppressing possible corrosion as much as possible, a UV epoxy resin material containing an amount of $Cl^{-1}$ ion not exceeding 50 ppm is used. Further, when the temperature of the MR element patterns 14 which is made of Permalloy is raised up to 150° C. or above, the MR characteristic of them deteriorates. In view of this, the protection film 15 is formed with a UV epoxy resin of a cold hardening type which can be formed at a temperature not exceeding 150° C.

With the MR head 8 thus prepared by forming the protection film 15 on the above-stated conditions, an accelerated environmental test was conducted. The test was conducted by immersing the MR head 8 in an artificial sweat (brine) and by applying a normal current of 1.2 mA. Through this test, an electrical fault took place in the MR element in one hour.

The cause for this fault seems to lie in that the water absorption coefficient by boiling of the UV epoxy resin is 0.4 weight % per hour and that the absorption of water causes the moisture content or ions of the sweat liquid to pass through the epoxy molecules. Although the UV epoxy resin has a lesser coefficient of absorption of water by boiling among other organic resins, the level of the coefficient seems to be still too high. In this respect, an inorganic system film, on the other hand, has nearly zero coefficient of water absorption by boiling.

Further, in the case of the UV epoxy resin, the strength of bond with the glass surface of the substrate is insufficient and tends to slightly peel off at the interface. A cross cut test has been conducted as specified by JIS. The result of this test indicated no peeling on the surface of Permalloy but showed some peeling of the epoxy resin off the surface of glass. This phenomenon has been confirmed also by the fact that the fault (breaking) of the MR element was accelerated when an energizing test was conducted after giving heat shocks 20 times at −20° C. and +70° C. before conducting the accelerated environmental test mentioned above. The weak bonding strength of interface seems to be ascribable either to the affinity between the glass and the epoxy resin or a difference in coefficient of linear expansion.

In the case of a protection film of an inorganic system, on the other hand, the bonding strength for glass is variable by selecting (1) the material, (2) the film forming method and (3) film forming means, so that a stronger bonding strength can be attained than in the case of the epoxy resin film.

Insulators of inorganic systems having excellent adhesion to the glass substrate include an insulator of an Si system. This material has a good affinity with $SiO_2$ which is the principal component of glass, because it seems to bring about Si—Si bond. However, the result of a test conducted by sputtering a protection film having exactly the same components as the glass substrate indicated an inferior film quality. Then, during the accelerated environmental test mentioned above, an alkali ion of $Pb^+$ or $Na^+$ was generated to quicken the electrical fault of the MR element, which took place within a period of about 10 hours, due to the inferior film quality.

Meanwhile, a film of $SiN_X$ (X=0.05 atomic % or more) can be made into a film of good adhesion at a temperature not exceeding 150° C. by reactive sputtering or ion plating. In the case of the $SiN_X$ film, the film is noncrystal, contains N at least 0.05 atomic % and changes into an insulator having electric resistance at least in a range from a value obtained by raising 10 ohms to the second power to a value obtained by raising 10 ohms to the 16th power. As regards the hardness, with $N_2$ included at least 0.05 atomic %, the film becomes Hk 2000 in Knoop hardness and, with $N_2$ preferably included 10 atomic % or more, the film becomes at least Hk 3000. Meanwhile, the hardness of the Si film itself does not exceed Hk 1000.

Further, a film of $SiO_Y$ (Y=0.05 atomic % or more) also can be made into a film of good adhesion at a temperature not exceeding 150° C. by reactive sputtering or ion plating like the $SiN_X$ film. The $SiO_Y$ film is also noncrystal and can be made into an insulator by including $O_2$ at least 0.05 atomic %. By this, its hardness also can be increased. However, compared with the $SiN_X$ film, the Knoop hardness of the $SiO_2$ film is low and can be increased only up to Hk 2000 at the most. The protection film must be hard, because any damage inflicted on the protection film by contact with a tool, forceps or the like during an assembly work on the MR element to such an extent that causes the MR element to be exposed to air tends to result in corrosion, which is very serious.

The $SiO_Y$ film can be formed by spin-coating an alkoxide of an Si system, $Si(OH)_4$ or the like and by drying it at a temperature not exceeding 150° C. Both the $SiO_Y$ and $SiN_X$ give fine films, because they do not have any grain boundary.

Examination of the state of electrical fault reveals that the electrical fault taking place with a protection film of an organic system employed differs from the fault taking place where a protection film of an inorganic system is employed. In the case of the organic system, the protection film is allowable to be relatively thick, though the allowable film thickness is limited to 25 μm, because a thickness exceeding 30 μm causes it to come into contact with the magnetic scale part. In this case, therefore, the film of the MR element is not electrolyzed immediately after application of a current with the MR head immersed in the brine as mentioned above. In the above-stated test, however, the Permalloy film of the MR element patterns located immediately below the outermost periphery of the protection film began to react to produce air bubbles after the lapse of about one hour. Then, the reaction spread all over in ten minutes. The reaction caused the films of adjoining element patterns to be corroded one after another like migration even though the film of one MR element pattern is separated from that of an adjoining MR element pattern by the glass of the substrate in the case of the epoxy UV resin film. The cause for this phenomenon seems to be as follows. Once the $Cl^{-1}$ or $Na^+$ ion of the brine and the Permalloy film come to react on each other, the electrolyte of the $Cl^{-1}$ ion jumps over the glass part to spread the corrosion all over either due to the ion permeating the epoxy or due to inadequate interface bonding.

In the case of an inorganic protection film having a high degree of adhesion like the $SiN_X$ film, the corrosion is considered to result from one of three causes including (1) a pinhole due to dust, (2) poor film quality which causes corrosion from above the film and (3) peeling of the MR element substrate and the film off from each other. The corrosion resulting from the causes (2) and (3) can be prevented by controlling the pressure of an Ar gas and that of an $N_2$ gas at the time of film forming by sputtering. Studies have been conducted for such reactive sputtering. However, it is very difficult to remove the cause (1) for corrosion, because it calls for elimination of dust of size exceeding 1 μm within an area of 5 mm×5 mm.

Figure 5:
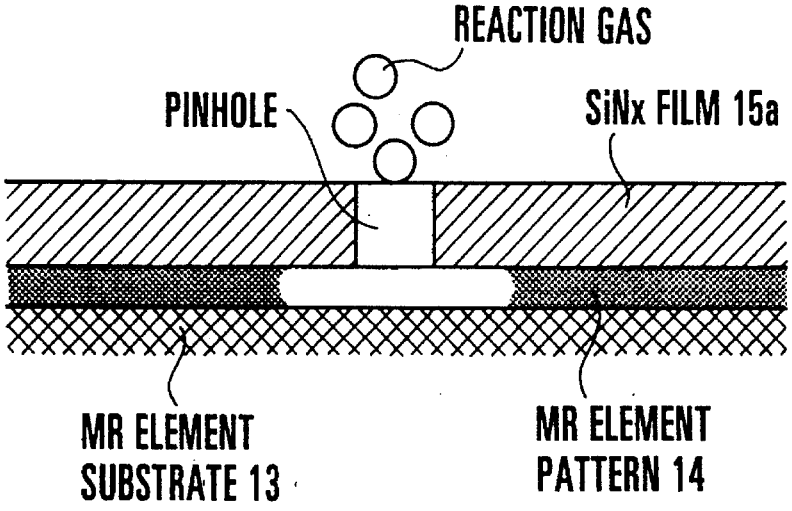
FIG. 5 is a sectional view showing the thin film of the MR element patterns in a state of having corrosion caused by a pinhole in a protection film.

In a case where the protection film of $SiN_X$ has a pinhole, the thin-film portion of the MR element pattern 14 which is located immediately below the pinhole of the $SiN_X$ protection film 15*a* corrodes as shown in FIG. 5. Microscopic observation of the corrosion reaction has revealed that the reaction which takes place on the surface of the Permalloy film immediately below the pinhole takes place to spurt out a reaction gas always after immersion in the brine and immediately after an electric current is applied. Although pinholes are considered to exist also on the glass surface, no reaction gas is spurted out as there is no reacting substances.

Further, the reaction taking place on the surface of the Permalloy thin film of the MR element patterns spreads in a circular state. However, unlike the protection film of the epoxy resin, the reaction does not progress from one pattern to an adjoining pattern by jumping over the glass part of the MR element substrate. This seems to be ascribable to a high degree of adhesion between the glass and the $SiN_X$ film. The reaction, in that case, comes to a stop at the border of one pattern. Further, unlike in the case of the epoxy resin, when the reaction begins, it does not at once spread all over. The reaction begins at a pinhole part after immersion and then gradually spreads spending much time through the Permalloy film before it eventually comes to cause a fault.

In the case of protection films which were made of only the $SiN_X$ film, films that withstood the test of immersion in brine and electric current application for at least 100 hours were determined by the rate of occurrence of pinholes. Only 10% or thereabout of films prepared within a clean room of Class 10,000 passed the test.

It is one of conceivable methods for improving the protection film to increase the thickness of the $SiN_X$ film. Generally, a film measuring 200 angstroms in thickness is better than a film of 100 angstroms. The thickness at a critical point where the number of pinholes greatly decreases is at least 500 angstroms. The number of pinholes gradually decreases accordingly as the thickness increases from 500 angstroms up to 5 μm. On the other hand, when the thickness exceeds 3 μm, a total stress comes to increase to cause the output of the MR element to gradually decrease. The output decreases to a considerable extent when the thickness exceeds 5 μm. Besides, in a case where the thickness is 3 μm or more, a considerably long period of time is necessary for film forming to greatly lower productivity.

In view of the above, the protection film is prepared in the form of a multilayer film. The multilayer film can be prepared in one of two different ways. In one way, a film layer which is to be located immediately over the ferromagnetic thin film of the MR element patterns is arranged to be an insulating inorganic film which excels in adhesion and has few pinholes and then an organic film layer which can be thickly applied at a low cost is formed over the inorganic film layer. In other words, with the film layer immediately above the ferromagnetic thin film arranged to be the insulating inorganic film which excels in adhesion and has few pinholes, a second inorganic film which has a fast film forming speed is applied as coating over the first inorganic film layer.

An $SiN_X$ film is most apposite to the protection film layer immediately above the thin film of the MR element patterns and the optimum thickness of it is from 1 to 2 μm or thereabout. In a case where an organic film layer is to be formed above the inorganic film layer, the organic film layer is most preferably made of a UV epoxy resin. This is because the UV epoxy resin has a low $Cl^{-1}$ ion concentration, has a high degree of adhesion and can be hardened at an ordinary temperature.

An optimum film for the protection film 15 is thus prepared as shown in FIG. 4 in the above-stated manner. Namely, the $SiN_X$ film 15*a* is formed immediately above the thin film of the MR element patterns 14. Then, the epoxy resin film 15*b* which is made of a UV epoxy resin is formed on the $SiN_X$ film 15*a*.

These films are formed in the following manner. A Permalloy film is formed by vapor deposition on a large glass plate which is to be cut into many pieces of the MR element substrate 13 later on. The film thus formed is processed into the shapes of the electrodes 16*a* and 16*b* and the MR element patterns 14 by etching. In this case, for example, at least one hundred and fifty patterns of the same shape which is as shown in FIG. 4 are formed together on one and the same large glass plate.

After that, the $SiN_X$ film 15*a* is sputtered to a thickness of 2 μm by masking only the lower sides of the electrodes 16*a* and 16*b* as viewed on FIG. 4. In other words, the $SiN_X$ film 15*a* is applied to cover the whole surface of the upper half part of the MR element substrate 13 as viewed on FIG. 4, including the all MR element patterns 14 and the electrodes 16*a* and 16*b*. The $SiN_X$ film 15*a* thus spreads to the borders of the large glass plate which become the outer edges of the MR element substrate 13 before cutting.

Next, the epoxy resin film 15*b* which is made of a UV epoxy resin is formed by screen printing to a thickness of 8 μm±3 μm. The epoxy resin film 15*b* then covers the whole MR element patterns 14 and the upper parts of the electrodes 16*a* and 16*b* from above the $SiN_X$ film 15*a* but is in a size not covering the borders along which the large glass plate is to be cut to give the outer edges of the MR element substrate 13. In other words, the epoxy resin film 15*b* is formed to be smaller than the $SiN_X$ film 15*a* in such a way as to have the whole peripheral edge of the epoxy resin film 15*b* located on the inner side of the whole peripheral edge of the $SiN_X$ film 15*a*. The reason for this lies in that, if the epoxy resin film 15*b* is cut in a state of covering a border line when the large glass plate is cut to the size of the MR element substrate 13 after the films are formed, the epoxy resin film 15*b* tends to peel off from its cut face. Further, the $SiN_X$ film 15*a* does not peel off when its is cut by a precision cutting edge because of its good adhesion.

Further, on the $SiN_X$ film, the epoxy resin film has a better adhesion than on the glass substrate and the possibility of its peeling from its end face lessens. The epoxy resin film 15*b* is thus formed to be smaller then the $SiN_X$ film 15*a* as mentioned above also in view of this.

After the epoxy resin film 15*b* is thus formed, the MR element part of the magnetic head 8 is completed by cutting the large glass plate to the size of the MR element substrate 13.

One hundred samples which were prepared in the above-stated manner were subjected to the accelerated environmental test described in the foregoing. All the 100 samples successfully withstood electric current application which lasted at least for 100 hours.

A protection film 15 which was prepared, as another embodiment of this invention, by sputtering a metal Cr to a thickness of 5 μm on the $SiN_X$ film in place of the epoxy resin film. One hundred samples of this were also subjected to the same test. All of them then also successfully withstood the electric current application.

Referring further to FIG. 4, a flexible printed circuit board (FPC) is cemented, after underlaying soldering, to the lower parts of the electrodes 16*a* and 16*b* which are left exposed. After that, to prevent corrosion, this part is thickly coated with a UV epoxy resin. The UV epoxy resin can be thickly applied as this part is located far away from the magnetic scale part 7.

Further, in the case of the embodiment shown in FIG. 4, the $SiN_X$ film 15*a* is arranged to cover the upper half of the MR element substrate 13, that is, the whole MR element patterns 14 and an area in the neighborhood of connection parts at which the electrodes 16*a* and 16*b* are connected to the MR element patterns 14. The reason for this arrangement is as follows. A lead electrode part of the MR element is formed in the lower part of the MR element substrate 13. If this part is also covered, the electrode part cannot be soldered. This arrangement may be changed to provide some open part for soldering and to have all but this part covered with the protection film.

The following describes a second embodiment which is an improvement over the first embodiment which has been described above. The second embodiment is prepared in consideration of shocks such as a heat shock.

In the event of occurrence of a heat shock or the like, if a protection film is in a shape such as the one employed by the first embodiment described, the Permalloy film at a boundary part of the $SiN_X$ film 15*a* might come to cause an electrical fault. This trouble is considered to result from linear convergence of the stress of the $SiN_X$ film 15*a*, that of the solder, etc., at the boundary part of the $SiN_X$ film 15*a*.

Figure 6A:
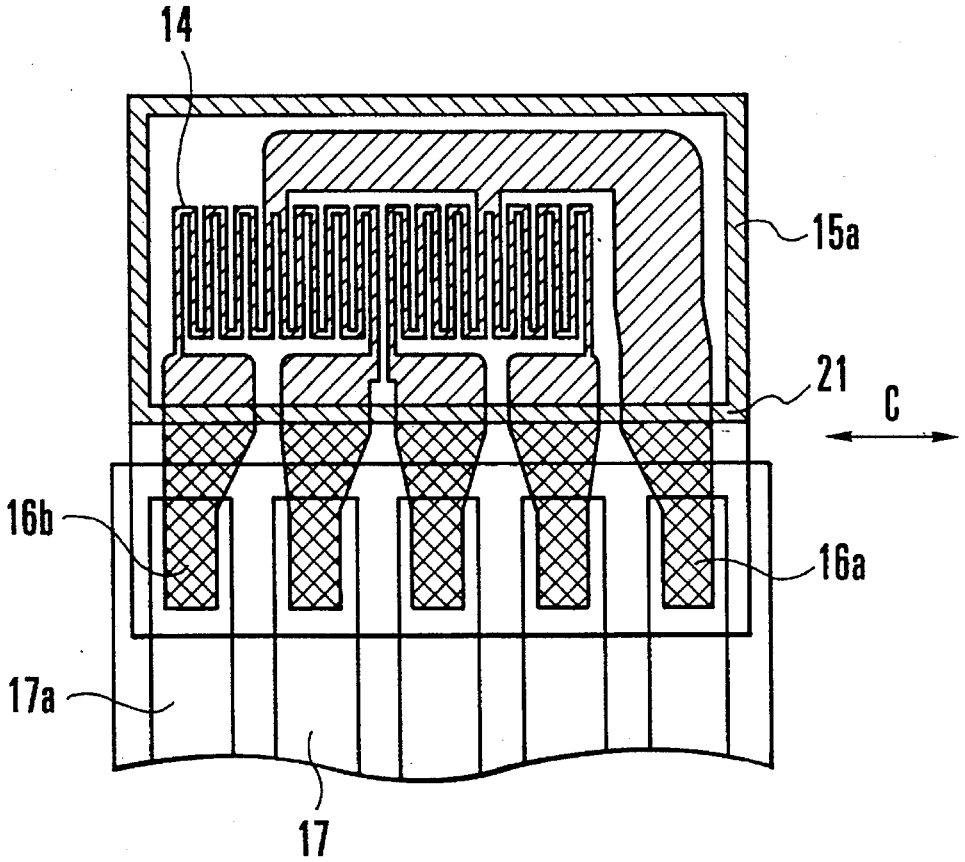
FIGS. 6(*a*) and 6(*b*) show by way of example a case where an FPC (flexible printed circuit) board is connected to the MR element part, FIG. 6(*a*) schematically showing it in a plan view and FIG. 6(*b*) showing essential parts in a sectional view.
Figure 6B:
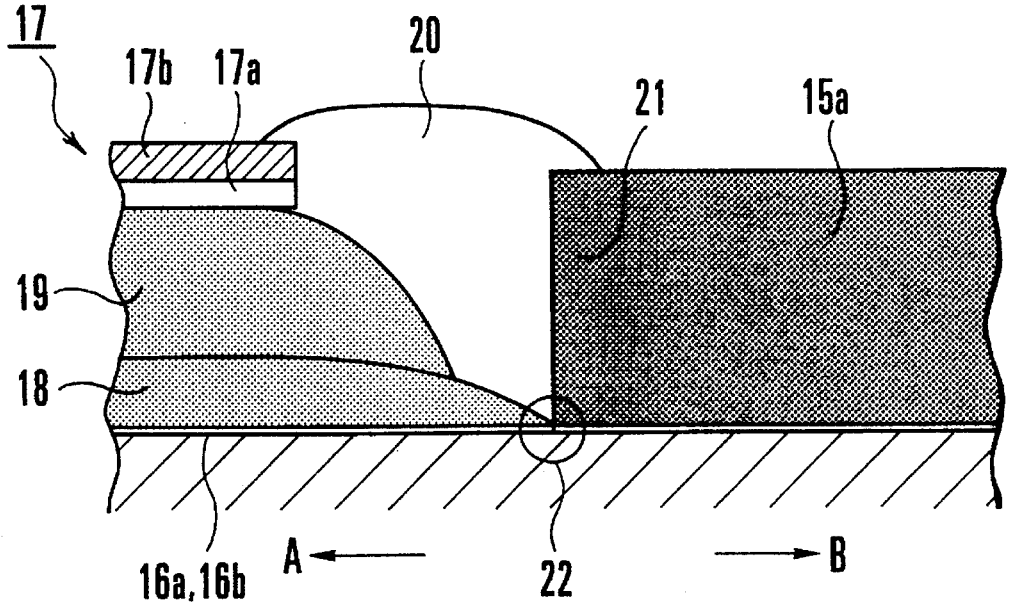

This trouble is described with reference to FIGS. 6(*a*) and 6(*b*) as follows. FIG. 6(*a*) shows in a plan view the electrodes 16*a* and 16*b* of the first embodiment shown in FIG. 4 as in a state of having the flexible printed circuit board connected thereto. FIG. 6(*b*) is a sectional view showing essential parts shown in FIG. 6(*a*).

The flexible printed circuit board (hereinafter referred to as FPC) 17 is provided with a conductor part 17*a* for outputting the result of detection by the MR element. The conductor part 17*a* of the FPC 17 is soldered to the electrodes 16*a* and 16*b*. The soldering work is carried out by first applying an underlaying solder layer 18 to the surface of the electrodes 16*a* and 16*b* and then by soldering the conductor part 17*a* of the FPC 17 by forming a solder layer 19 above the underlaying solder layer 18. A protection film 20 is formed in such a way as to cover one end part 21 of the $SiN_X$ film 15*a*. According to such arrangement, since the thickness of the electrodes 16*a* and 16*b* is thin (about 500 angstroms and is the same as the thickness of the MR element patterns 14), a crack might take place in a boundary part 22 between the underlaying solder layer 18 and the $SiN_X$ film 15*a* and, in the worst case, might cause an electrical fault. A cause for this trouble seems to be as described below.

In connecting the FPC 17 to the electrodes 16*a* and 16*b*, the solder layers 18 and 19 melt and then cool. A contraction stress then works in the direction of arrow A as shown in FIG. 6(*b*). Further, since the $SiN_X$ film 15*a* on the electrodes 16*a* and 16*b* is formed either by a vapor deposition or sputtering method, stress works in the direction of arrow B as shown in FIG. 6(*b*) while the film is in process of contraction. Therefore, the stress concentrates at the boundary part 22. Further, since a flux is used in forming the underlaying solder layer 18 on the electrodes 16*a* and 16*b*, chloride ion, etc., contained in the flux bring about a chemical reaction with the electrodes 16*a* and 16*b* which are made of a ferromagnetic thin film and thus melt the electrodes 16*a* and 16*b*. These phenomena further combine together to bring about stress corrosion at the boundary part 22. Further, when the magnetic head 8 is left under a high humidity condition in an energized state, the moisture becomes an electrolyte to electrolyze the electrodes 16*a* and 16*b*. This phenomenon conspicuously takes place at the boundary part 22.

A crack or electrical fault almost linearly takes place due to the above-stated causes. The fault takes place along one end part 21 of the $SiN_X$ film 15*a*, i.e., in the direction of arrow C as shown in FIG. 6(*a*).

To avoid these phenomena, the second embodiment which is mentioned in the following is arranged to use an anisotropic conductive film in place of solder to cover at least a part of the $SiN_X$ film 15*a*. The second embodiment is described in detail with reference to FIG. 7 as follows.

Figure 7:
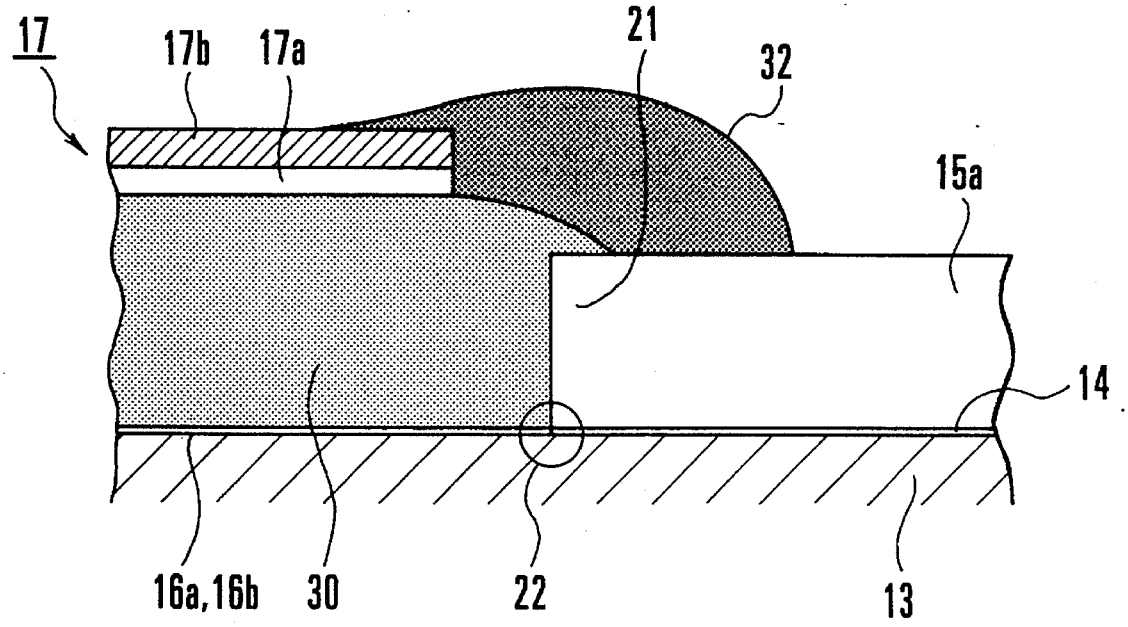
FIG. 7 is a sectional view showing the essential parts of a modification example of the embodiment.
Figure 8A:
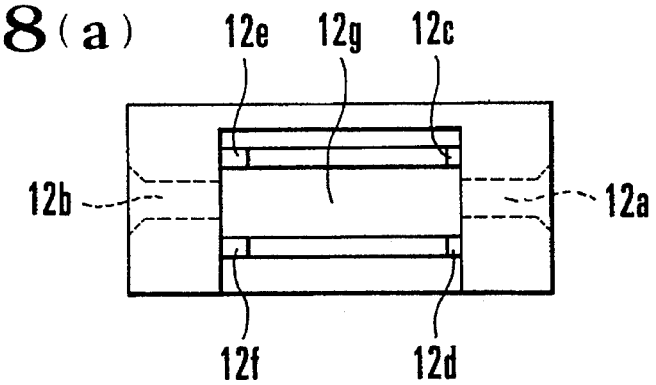
FIGS. 8(*a*), 8(*b*), 8(*c*), 8(*d*) and 8(*e*) show a practical arrangement of a slider in the embodiment.
Figure 8B:
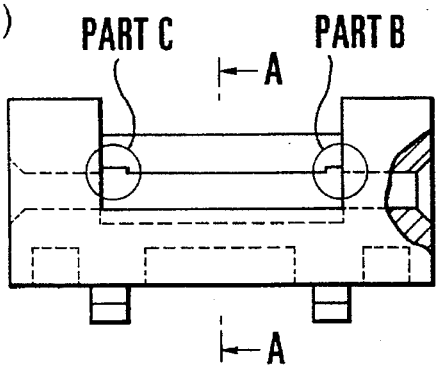
Figure 8C:
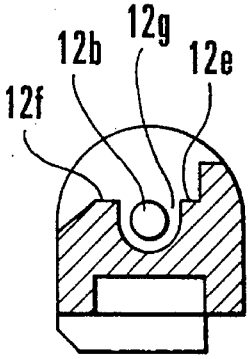
Figure 8E:
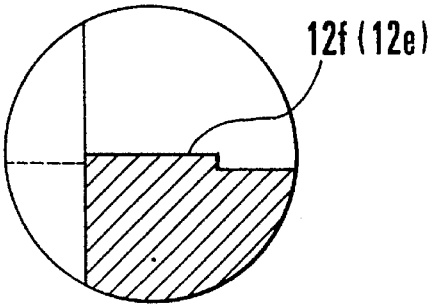
Figure 8D:
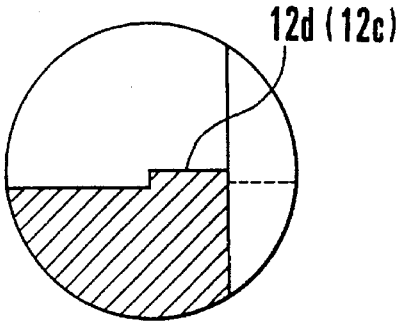

As shown in FIG. 7, an anisotropic conductive film 30 is overlaid on the electrodes 16*a* and 16*b* which are connected to the MR element patterns 14. At least the end part 21 of the $SiN_X$ film 15*a* is covered with the anisotropic conductive film 30, which is formed in the following manner. An adhesive film (theremosetting resin) measuring 20 to 30 μm in thickness containing conductive grains measuring 3 to 51 μm in diameter, such as solder grains, Ni grains or C grains, is inserted in between the FPC 17 and the electrodes 16*a* and 16*b* and is then formed into the anisotropic conductive film 30 by heating and pressing. The adhesive film itself is an insulator as the conductive grains dispersedly exist independently of each other. However, the heating and pressing processes bind the conductive grains together to cause the adhesive film to act as a conductor. Therefore, the adhesive film not only binds the conductor part 17*a* of the FPC 17 and the electrodes 16*a* and 16*b* together but also makes them conductive. The use of the anisotropic conductive film 30 obviates the necessity of use of a flux and eliminates the fear of corrosion resulting from the use of the flux. Furthermore, the fear of diffusion of the Permalloy film (electrodes 16*a* and 16*b*) due to a flux is also eliminated.

Further, in the case of the second embodiment, a flexible resin 32 such as an epoxy resin, a UV acrylic resin or the like is provided on the FPC 17, the anisotropic conductive film 30 and the $SiN_X$ film 15*a* for the purpose of increasing the bonding strength of the FPC 17 and the electrodes 16*a* and 16*b*. The flexible resin 32 not only increases the bonding strength but also doubly prevents permeation of moisture and ions from outside.

With the embodiment arranged as described above, the anisotropic conductive film 30 which is formed above the electrodes 16*a* and 16*b* prevents the electrodes 16*a* and 16*b* from having any electrical fault that tends to be caused, like in the case of soldering, by the corrosion of the Permalloy film which forms the electrodes 16*a* and 16*b*.

Further, since the anisotropic conductive film 30 covers the end part 21 of the $SiN_X$ film 15*a*, no stress concentration takes place at the boundary part 22.

The slider 12 mentioned in the foregoing is next described in detail as follows. In the case of this embodiment, the slider 12 is formed with a polyphenylene sulfide (hereinafter referred to as PPS) material which contains glass filler. The glass filler content is set at 10 to 50% or thereabout. The use of this material is decided on the following reason. The magnetic head 8 in this embodiment has the MR element patterns 14 formed on the substrate 13 which is made of glass. The substrate 13 is mounted on the slider 12 by resin adhesion. Too much difference in linear expansion coefficient between the substrate 13 (glass) and the slider 12 might cause the substrate 13 to be broken by cooling after the adhesion.

It has been ascertained through an experiment that the substrate 13 can be prevented from cracking by arranging the linear expansion coefficient of the slider 12 to be not exceeding $5\times10^{-5}$/°C. while that of the substrate 13 is $1\times10^{-5}$/°C. This value can be attained by arranging the PPS material to contain about 10% of glass filler. According to the results of the experiment, the substrate 13 cracks within a temperature range from −20° C. to 80° C. if the linear expansion coefficient exceeds the value of $5\times10^{-5}$/°C.

The magnetic scale part (wire) 7 has a small diameter measuring only 1 mm and is magnetized to have alternately N and S poles at a pitch not exceeding 50 μm. Therefore, a magnetic flux transmitted to the magnetic head 8 is small to make the output of the magnetic head 8 very small. In order to minimize fluctuations in the characteristic of the output, it is important to arrange the slider 12 and the magnetic scale part 7 to have a small gap between them and to keep the gap unvarying. In the case of this embodiment, the gap is set at about 5 to 20 μm. Then, to ensure an adequate sliding state despite of such a gap, the slider 12 is made of the PPS material. The gap which is thus arranged to be very small effectively prevents dust and ink from intruding into the slider 12.

Further, since the gap between the slider 12 and the magnetic scale part 7 is vary small, if the slider 12 has a large coefficient of water absorption,.the slider 12 would expand under a high humidity condition and, in the worst case, might become incapable of sliding over the magnetic scale part 7. However, since the coefficient of water absorption of the PPS is only about 0.1%, there is no fear of such expansion. Further, in a case where the PPS material arranged to contain about 10% of glass filler, the coefficient of water absorption becomes about 0.05 % to give a still better condition. If the glass filler content is increased, the coefficient of water absorption further decreases. The coefficient became 0.03% with the glass filler content increased to 30% and 0.02% with the glass filler content increased to 50%. Further, with the glass filler content increased to 30% and 50%, the above-stated coefficient of linear expansion became $4\times10^{-5}$/°C. and $3\times10^{-5}$/°C., respectively.

While the PPS material is arranged to contain a glass filler in the case of the embodiment described, the glass filler may be replaced with some other inorganic filler that has low expansion coefficient, such as a titanium oxide filler. It was also found effective to arrange the PPS material to contain carbon fiber.

An example in which the slider 12 is prepared with the PPS material arranged to contain the glass filler is described below with reference to FIGS. 8(*a*) to 8(*e*). FIG. 8(*a*) is a plan view of the slider 12. FIG. 8(*b*) is a front view of the slider 12. FIG. 8(*c*) is a sectional view taken along a line A—A shown in FIG. 8(*b*). FIG. 8(*d*) is an enlarged view of a part B shown in FIG. 8(*b*). FIG. 8(*e*) is an enlarged view of a part C shown in FIG. 8 (*b*).

The slider 12 includes receiving parts 12*a* and 12*b* which are arranged to have the magnetic scale part 7 fitted therein. The slider 12 further includes support parts 12*c*, 12*d*, 12*e* and 12*f* which are arranged to have the MR element substrate 13 secured thereto. These support parts 12*c*, 12*d*, 12*e* and 12*f* are in a stepped state as shown in FIGS. 8(*d*) and 8(*e*). One side of the substrate 13 on which the protection film 15 is formed is attached to these support parts 12*c*, 12*d*, 12*e* and 12*f*. The film thickness of the protection film 15 is arranged not to exceed 10 μm±3 μm as mentioned in the foregoing. Besides, since these support parts 12*c*, 12*d*, 12*e* and 12*f* can be formed to have their profile irregularity within 5 μm, the gap "g" between the magnetic scale part 7 and the MR element patterns 14 can be kept highly precise.

Further, since the PPS material excels in mold transferability, the above-stated profile irregularity can be attained. However, according to the results of an experiment, if the glass filler added in connection with thermal expansion (contraction) and water absorption exceeds 50%, the mold transferability degrades and the mechanical strength of the slider 12 decreases.

With the protection film 15 arranged to cover the half of the substrate as shown in FIG. 4, its height is adjustable by varying the height of the support parts 12*c* and 12*e* and the support parts 12*d* and 12*f*.

Further, since the $SiN_X$ film 15*a* can be more accurately attached than the epoxy resin film 15*b*, the slider 12 can be accurately mounted by forming the protection film 15 by removing the peripheral part of the epoxy resin film 15*b* and by thus allowing the support parts 12*c*, 12*d*, 12*e* and 12*f* to abut on the $SiN_X$ film 15*a*.

As apparent from the description given above, the embodiment is arranged to have the slider 12 formed with the PPS material containing 10 to 50% of a filler. In accordance with this simple arrangement, a recording apparatus can be provided with a magnetic scale part which is capable of making accurate detection even under a high humidity environmental condition.

Further, in the embodiment, the slider 12 is integrally formed with the PPS material. Since the opening parts provided in the slider 12 include only the receiving (opening) parts 12*a* and 12*b* which are arranged to have the magnetic scale part 7 fitted therein and a opening part 12*g* which is arranged to have the MR element patterns 14 opposed to the magnetic scale part 7, dust, ink, etc., therefore, can be effectively prevented from entering the inside of the slider 12.

While preferred embodiments have been described in relation to a recording apparatus, this invention is not limited to such recording apparatuses. It should be understood that the carriage position detecting device arranged for the recording apparatus according to this invention is applicable also to other apparatuses.

What is claimed is:

1. A recording apparatus for performing a recording operation by moving a carriage on which recording means is mounted, comprising:

a) a first member arranged in parallel to a moving locus of a carriage to have position information recorded in a longitudinal direction thereof;

b) detecting means for detecting the position information and including a substrate and detecting element disposed on said substrate and a protection film formed over said detecting element; and c) a second member arranged to have said first member slidably fitted therein and to hold said detecting means in such a way as to enable said detecting means to read the position information recorded on said first member, said second member being formed with a polyphenylene sulfide material containing 10 to 50% of a filler.

2. An apparatus according to claim 1, wherein said filler is an inorganic filler which has a low coefficient of expansion.

3. An apparatus according to claim 2, wherein said inorganic filler consists of glass.

4. An apparatus according to claim 1, wherein said substrate is secured to said second member in such a manner that said detecting element is opposed to said first member.

5. An apparatus according to claim 4, wherein a coefficient of linear expansion of said second member is nearly equal to that of said substrate.

6. An apparatus according to claim 4, wherein said detecting element is a magnetoresistive element.

7. An apparatus according to claim 6, wherein the position information is magnetically recorded on said first member at a predetermined pitch.

8. An apparatus according to claim 1, wherein said substrate is secured to said second member through said protection film.

9. An apparatus according to claim 8, wherein said protection film is made of $SiN_X$.

10. A recording apparatus for performing a recording operation by moving a carriage on which recording means is mounted, comprising:

a) a first member arranged in parallel to a moving locus of a carriage to have position information recorded in a longitudinal direction thereof;

b) detecting means for detecting the position information and including a substrate and detecting element disposed on said substrate and a protection film formed over said detecting element; and c) a second member arranged to have said first member slidably fitted therein and to hold said detecting means in such a way as to enable said detecting means to read the position information recorded on said first member, said second member being an integrally formed member and having only three opening parts including first and second opening parts in which said first member is fitted and a third opening part through which the position information is read by said detecting means held by said second member.

11. An apparatus according to claim 10, wherein said second member is made of a polyphenylene sulfide material containing 10 to 20% of a filler.

12. An apparatus according to claim 11, wherein said substrate is secured to said second member in such a manner that said detecting element is opposed to said first member.

13. An apparatus according to claim 12, wherein a coefficient of linear expansion of said second member is nearly equal to that of said substrate.

14. An apparatus according to claim 10, wherein said substrate is secured to said second member through said protection film.

15. An apparatus according to claim 14, wherein said protection film is made of $SiN_X$.

16. An apparatus according to claim 12, wherein said detecting element is a magnetoresistive element.

17. An apparatus according to claim 16, wherein the position information is magnetically recorded on said first member at a predetermined pitch.

18. An apparatus according to claim 11, wherein said filler is an inorganic filler which has a low coefficient of expansion.

19. An apparatus according to claim 18, wherein said inorganic filler consists of glass.

20. An information reading device comprising:

a) a first member having information recorded thereon in a longitudinal direction thereof;

b) reading means capable of reading the information and including a substrate and a reading element disposed on said substrate and a protection film formed over said reading element; and c) a second member arranged to have said first member slidably fitted therein and to hold said reading means in such a way to enable said reading means to read the information recorded on said first member, said second member being formed with a polyphenylene sulfide material containing 10 to 50% of a filler.

21. A device according to claim 20, wherein said filler is an inorganic filler which has a low coefficient of expansion.

22. A device according to claim 21, wherein said inorganic filler consists of glass.

23. A device according to claim 22, wherein said substrate is secured to said second member in such a manner that said reading element is opposed to said first member.

24. A device according to claim 23, wherein a coefficient of linear expansion of said second member is nearly equal to that of said substrate.

25. A device according to claim 20, wherein said substrate is secured to said second member through said protection film.

26. A device according to claim 25, wherein said protection film is made of $SiN_X$.

27. A device according to claim 23, wherein said reading element is a magnetoresistive element.

28. A device according to claim 27, wherein said first member has the information magnetically recorded thereon at a predetermined pitch.

29. An information reading device comprising:

a) a first member having information recorded thereon in a longitudinal direction thereof;

b) reading means capable of reading the information and including a substrate and a reading element disposed on said substrate and a protection film formed over said reading element; and c) a second member arranged to have said first member slidably fitted therein and to hold said reading means in such a way as to enable said reading means to read the information recorded on said first member, said second member being an integrally formed member and having only three opening parts including first and second opening parts in which said first member is fitted and a third opening part through which the information is read by said reading means held by said second member.

30. A device according to claim 29, wherein said second member is made of a polyphenylene sulfide material containing 10 to 50% of a filler.

31. A device according to claim 30, wherein said substrate is secured to said second member in such a manner that said reading element is opposed to said first member.

32. A device according to claim 31, wherein a coefficient of linear expansion of said second member is nearly equal to that of said substrate.

33. A device according to claim 29, wherein said substrate is secured to said second member through said protection film.

34. A device according to claim 33, wherein said protection film is made of $SiN_X$.

35. A device according to claim 31, wherein said reading element is a magnetoresistive element.

36. A device according to claim 35, wherein said first member has the information magnetically recorded thereon at a predetermined pitch.

37. A device according to claim 30, wherein said filler is an inorganic filler which has a low coefficient of expansion.

38. A device according to claim 37, wherein said inorganic filler consists of glass.

39. An information reading device comprising:

a) a first member having information recorded thereon in a longitudinal direction thereof;

b) a second member arranged to have said first member slidably fitted therein and to have a coefficient of linear expansion not exceeding $5\times10^{-5}$/°C. and a coefficient of water absorption not exceeding 0.1%; and c) reading means including a glass substrate and a reading element disposed on said glass substrate, said reading element including a protection film formed over said reading element, said glass substrate being secured to said second member in such a manner that said reading element is opposed to said first member.

40. A device according to claim 39, wherein said second member is arranged to have only three opening parts including first and second opening parts in which said first member is fitted and a third opening part though which the information is read by said reading means held by said second member.

41. A device according to claim 39, wherein said second member is made of a polyphenylene sulfide material containing 10 to 50% of a filler.

42. A device according to claim 39, wherein said glass substrate is secured to said second member through said protection film.

43. A device according to claim 42, wherein said protection film is made of $SiN_X$.

44. A device according to claim 39, wherein said reading element is a magnetoresistive element.

45. A device according to claim 44, wherein said first member has the information magnetically recorded thereon at a predetermined pitch.

46. A device according to claim 41, wherein said filler is an inorganic filler which has a low coefficient of expansion.

47. A device according to claim 46, wherein said inorganic filler consists of glass.

* * * * *

UNITED STATES PATENT AND TRADEMARK OFFICE

CERTIFICATE OF CORRECTION

PATENT NO. : 5,575,577

DATED : November 19, 1996

INVENTOR(S) : Yoshio Kawakami, et al

It is certified that error appears in the above-indentified patent and that said Letters Patent is hereby corrected as shown below:

Col. 14, line 5, change "claim 22" to -- claim 20 --.

Signed and Sealed this

Tenth Day of June, 1997

*Attest:*

*Attesting Officer*

Bruce Lehman

BRUCE LEHMAN

*Commissioner of Patents and Trademarks*